US007300354B2

(12) United States Patent
Field et al.

(10) Patent No.: US 7,300,354 B2
(45) Date of Patent: Nov. 27, 2007

(54) INFLATABLE SLIDE OR BOUNCER

(75) Inventors: Robert Field, Lakeville, MN (US); Brian Field, Inver Grove Heights, MN (US)

(73) Assignee: Cutting Edge Creations, Inc., Eagan, MN (US)

( * ) Notice: Subject to any disclaimer, the term of this patent is extended or adjusted under 35 U.S.C. 154(b) by 0 days.

(21) Appl. No.: 10/714,566

(22) Filed: Nov. 14, 2003

(65) Prior Publication Data

US 2005/0107175 A1 May 19, 2005

(51) Int. Cl.
*A63G 21/18* (2006.01)

(52) U.S. Cl. ..... 472/117; 472/134; 52/2.24

(58) Field of Classification Search ..... 472/116, 472/117, 128, 129, 134; 52/2.24, 2.22, 2.23
See application file for complete search history.

(56) References Cited

U.S. PATENT DOCUMENTS 4,103,369 A * 8/1978 Riordan ..... 52/2.14
4,369,591 A * 1/1983 Vicino ..... 40/610
5,462,505 A * 10/1995 Blair et al. ..... 482/27
5,476,404 A * 12/1995 Price ..... 441/131
5,603,185 A * 2/1997 Murphy ..... 52/2.17
5,769,725 A * 6/1998 Ogden et al. ..... 472/59
5,772,535 A * 6/1998 Murphy ..... 473/415
6,062,983 A * 5/2000 Butsook ..... 472/117
6,364,782 B1 * 4/2002 Ochi ..... 472/134
6,402,627 B1 * 6/2002 Gordon ..... 472/114
6,406,377 B1 * 6/2002 Demko ..... 472/117
6,558,264 B2 * 5/2003 Gordon ..... 472/117
6,595,861 B1 * 7/2003 Morrow et al. ..... 472/134
6,648,767 B1 * 11/2003 Chen ..... 472/117

* cited by examiner

*Primary Examiner*—Kien T. Nguyen
(74) *Attorney, Agent, or Firm*—Schwegman, Lundberg & Woessner, P.A.

(57) ABSTRACT

An inflatable structure includes a first inflatable section having an interior open to an airflow from a blower, and a second inflatable section attached to the first inflatable section and having an interior that is substantially closed from the airflow such that if the airflow is stopped the second inflatable section will not deflate as fast as the first inflatable section and will support the first inflatable section.

7 Claims, 4 Drawing Sheets

INFLATABLE SLIDE OR BOUNCER

FIELD

This invention relates to the field of inflatables, and more specifically to inflatable slides.

BACKGROUND

Inflatables, such as inflatable slides, are air-inflated devices that are typically includes used for children's amusement. Inflatables have been designed to resemble real-life objects, such as ships, fire trucks, and animals. An inflatable slide typically includes a stairway, a slide portion, and side walls. The entire structure being air-inflated. Air constantly leaks from such an inflatable so a continually running blower is used to keep the inflatable pressurized and supported. If the blower is stopped or the airflow reduced, the entire structure can rapidly depressurize and deflate. What is needed is a design allowing for heightened safety for users of the inflatable.

SUMMARY

An inflatable structure includes a first inflatable section having an interior open to an airflow from a blower, and a second inflatable section attached to the first inflatable section and having an interior that is substantially closed from the airflow such that if the airflow is stopped the second inflatable section will not deflate as fast as the first inflatable section so as to support the first inflatable section.

DETAILED DESCRIPTION

The following detailed description and accompanying drawings show various embodiments according to the inventive subject matter disclosed herein. These embodiments are described in sufficient detail to enable those skilled in the art to practice the invention. Other embodiments may be utilized and structural changes may be made without departing from the scope of the present invention.

Figure 1:
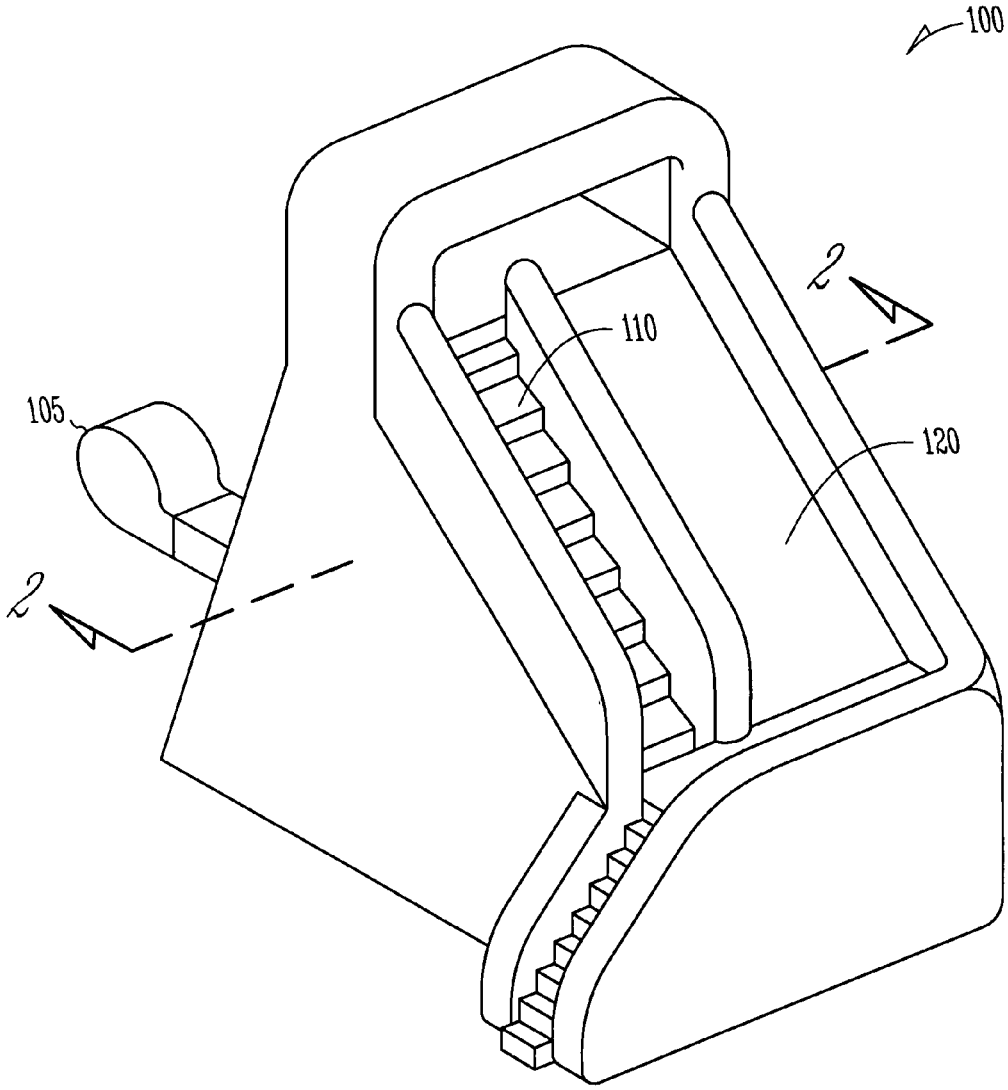
FIG. 1 shows a perspective view of an inflatable structure according to one embodiment of the inventive subject matter disclosed herein.

FIG. 1 shows a perspective view of an inflatable structure 100 according to one embodiment. Inflatable structure 100 is an inflatable slide in this example. Other embodiments can include other inflatable structures designed to support children or adults while being played on, such as bouncers, climbing walls, or other air-inflated structures. Some embodiments can include other inflatable units such as inflatable amusement or advertising structures.

In this example, inflatable structure 100 is a vinyl structure and includes a stairway 110 which extends to a slide

120. Various examples of such structures can range from 15 feet high to 35 feet high, or higher. A blower 105 is attached to the inflatable structure 100 to continually blow air into the interior of the structure to support the inflatable structure. Blower 105 is a high output blower and is typically a high pressure-low volume blower when used to inflate an inflatable slide. In the past, if a blower stopped working for any reason, air within an inflatable structure would immediately exit through the blower causing the structure to deflate rapidly. This can be an inconvenience at best and may be dangerous if a person is on the structure.

Figure 5:
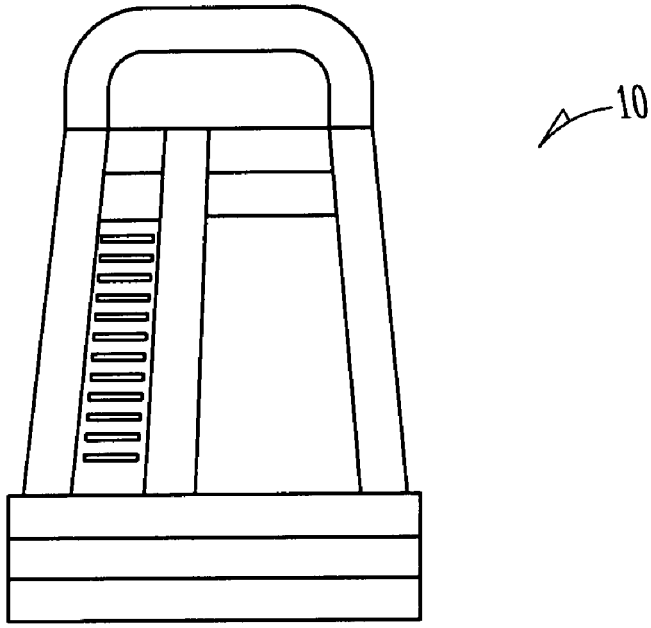
Fig. 5 (Prior Art)
FIG. 5 shows a schematic front view of a prior art inflatable structure.
Figure 6:
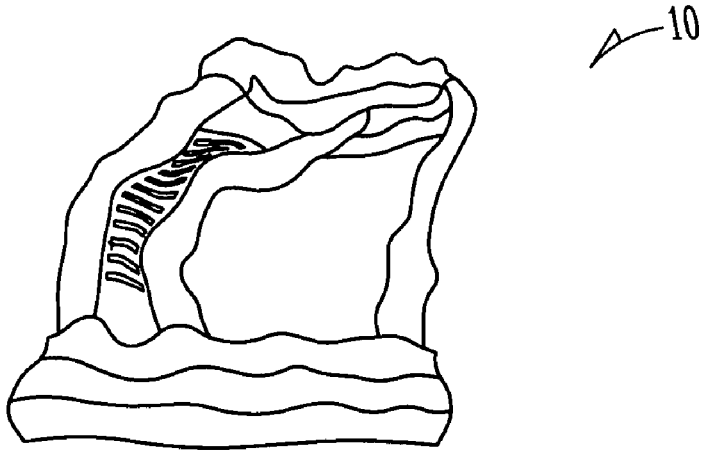
Fig. 6 (Prior Art)
FIG. 6 shows another schematic front view of the prior art inflatable structure.

For example, FIGS. 5 and 6 shows a prior art inflatable 10. In FIG. 5, the inflatable is inflated and pressurized by a continually running blower. FIG. 6 shows an example of inflatable 10 collapsing after the blower is stopped or has its airflow substantially reduced.

One embodiment of the inventive subject matter disclosed herein provides a safety feature to prevent an inflatable structure from collapsing or tipping over if the blower stops or the airflow through the blower is reduced.

Figure 2:
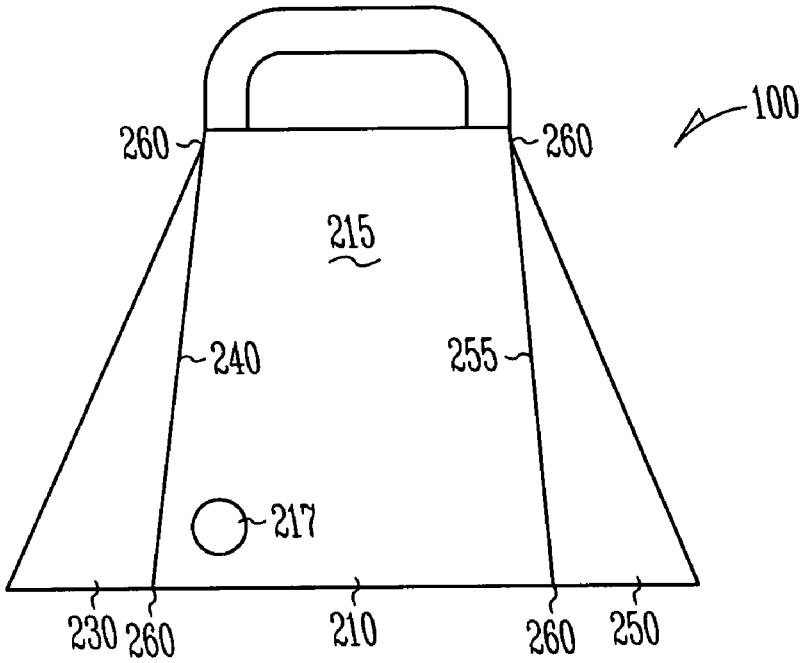
FIG. 2 shows a cross-section view of the inflatable structure of FIG. 1.

FIG. 2 shows a cross-section view of structure 100. Structure 100 includes a first inflatable section 210 having an interior 215 open to the airflow from blower 105 (FIG. 1) through an inlet 217. The first inflatable section 210 is adapted to be inflated and supported by the blower when the blower is running continually. As noted above, since there is a constant air leakage from inflatables, a continually running blower is need to keep the inflatable pressurized and inflated. The inflatable further includes a second inflatable section 230 that is attached to a side of first inflatable section 210. Second section 230 and first section 210 are separated by a wall 240. One embodiment includes a third inflatable section 250 that is attached to a second side of first section 210 and separated from the interior of the first section by a wall 255.

The interior of the first inflatable section 210 and the interior of the second and third inflatable sections, 230 and 250, are substantially separated. This means the airflow is not directly into the second and third sections but comes through small holes such as needle holes at seams 260 between the middle section and the outer sections. Some examples provide small holes directly through the wall surface between the sections. A small amount of air may also flow through the vinyl material of walls 240 and 255. Accordingly, the second and third sections 230 and 250 are substantially closed from the airflow coming into first section 210 from the blower. This causes the second and third sections to inflate slower than the first section 210. The structure also causes the second and third sections to deflate slower than the first section since air can rapidly leave section 210 through blower inlet 217, but can only leave sections 230 and 250 through seam holes or defusing through the material itself. For example, it can take 5 to 20 minutes longer to fully inflate sections 230 and 250 relative to section 210. Likewise, the deflation of the supporting sections can be at least 5 minutes greater than the first section and can be even 30 minutes or greater. Accordingly, if the airflow is stopped the second and third inflatable sections will not deflate as fast as the first inflatable section, this allows them to support the structure 100 while people can get off the structure safely.

Figure 3:
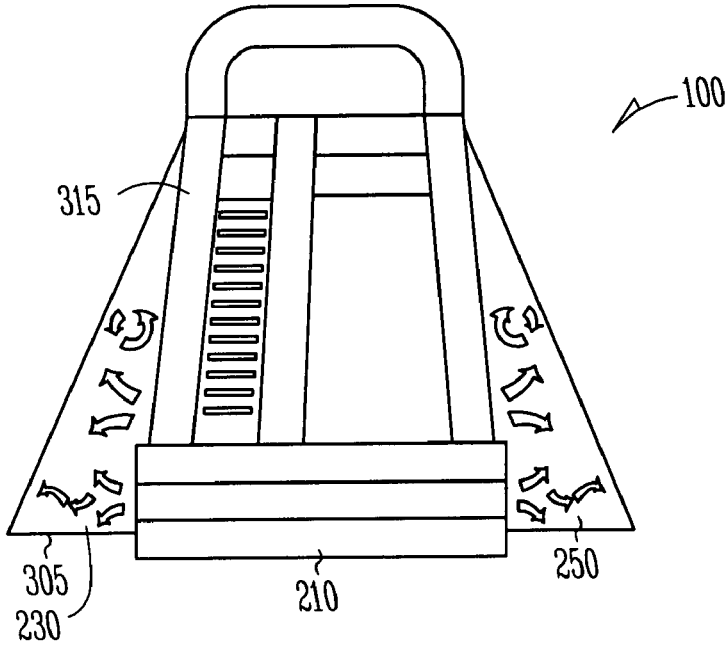
FIG. 3 shows a schematic front view of the inflatable structure of FIG. 1.
Figure 4:
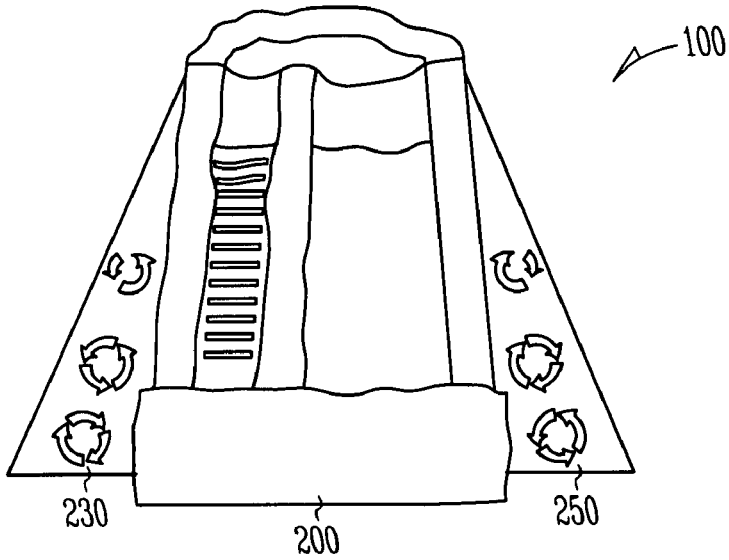
FIG. 4 shows a schematic front view of the inflatable structure of FIG. 1.

FIG. 3 shows a front view of inflatable 100 with a continual airflow being blown into the structure. FIG. 4 shows an example when the airflow is stopped or reduced into the inflatable structure 100. First section 210 depressurizes and deflates with the air leaving through inlet 217 (FIG. 2). A small amount of air flows into the first section 210 from second and third sections, 230 and 250, through seam holes. However, as noted above, this air takes much longer to be emitted, thus leaving sections 230 and 250 inflated for a longer time than the middle section. The sections 230 and 250 remain vertically oriented and supported by air and thus support section 210 between themselves to prevent the structure from collapsing or tipping over.

The second and third inflatable sections 230 and 250 each include a lower surface 305 resting on a ground surface and are attached to the sides of the first inflatable section. They therefore support the middle section even though the middle section is deflating and depressurized. This prevents the entire structure 100 from collapsing or tipping over. In this example, sections 230 and 250 have an upper section 315 which is attached to section 210 so as to provide support all the way to the top of the stairway and slide so as to support the structure at least up to the height of the slide. In various examples, the supporting sections 230 and 250 can have different heights. For example, some embodiments have an upper section 315 attached about half-way up the structure or about three-quarters of the way up the structure.

Thus in use, inflatable structure 100 is inflated so that at least two sections are air-inflated but are separated by a wall such that if an airflow into the first air-filled section is reduced the second section stays inflated for a longer time than the first section. This at least temporarily supports the inflatable structure if the airflow into the inflatable structure is reduced to a level that does not support the inflatable structure.

One aspect of the inventive subject matter is a method including inflating an inflatable structure with an airflow from a continually running blower and at least temporarily supporting the inflatable structure if the airflow into the inflatable structure is reduced to a level that does not support the inflatable structure. At least temporarily supporting can include providing a separate inflatable section of the inflatable structure that does not include a direct opening to the airflow.

One embodiment includes an inflatable having a first inflatable portion in open communication with air-flow from a blower and one or more secondary inflatable portions attached to the first inflatable portion. The secondary inflatable portions are not in open communication with the air-flow but are inflated through seams between the first inflatable portion and the secondary portions or from small holes between the first inflatable portion and the secondary portions. If the blower stops for any reason, the secondary portions do not immediately deflate but instead provide temporary support to the first inflatable portion.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed:

1. An apparatus comprising:

a first inflatable section having an interior open to an airflow from a continually running blower which provides support for the first inflatable section, the apparatus of a type such that the apparatus is safely usable as long as the blower is continually running;

a second inflatable section attached to a first side of the first inflatable section and having an interior that is substantially separated from the interior of the first inflatable section; and a third inflatable section attached to a second side of the first inflatable section and having an interior that is substantially separated from the interior of the first inflatable section, wherein the second inflatable section and the third inflatable section are configured such that if the airflow into the first inflatable section from the blower is stopped the second inflatable section and the third inflatable section will not deflate as fast as the first inflatable section, wherein the second inflatable section and the third inflatable section provide support to the first inflatable section when the airflow into the first inflatable section from the blower is stopped, wherein the second inflatable section includes a lower surface resting on a ground surface and a side surface attached at least half-way up a side of the first inflatable section.

2. The apparatus of claim 1, wherein the first inflatable section includes a top surface defining a slide.

3. The apparatus of claim 2, wherein the second inflatable section supports the first inflatable section at substantially the full height of the first inflatable section when the airflow is stopped.

4. The apparatus of claim 1, wherein the airflow into the second section flows through seam-holes between the first and second section.

5. An apparatus comprising:

an inflatable structure having a first inflatable portion defining a slide having a height of at least 15 feet and a stairway extending to the top of the slide, the first inflatable portion having an interior volume open to an air-flow from a blower and adapted to be pressurized by the blower running continually such that the inflatable structure is safely usable as long as the blower is running, the inflatable structure including a second inflatable portion attached to the first inflatable portion and having a bottom surface resting on a ground surface and a top section attached to the first inflatable portion at a height at least halfway up the first inflatable portion, the second inflatable portion not having direct communication with the airflow such that the second inflatable portion inflates slower than the first inflatable portion and also deflates slower than the first inflatable portion, wherein if the airflow from the blower is stopped or reduced the second inflatable portion will at least temporarily support the first inflatable portion.

6. The apparatus of claim 5, wherein the second inflatable portion receives a portion of the airflow through holes at a seam between the first inflatable portion and the inflatable portion section.

7. The apparatus of claim 5, including a third inflatable portion attached to the first inflatable portion, the third inflatable portion not having direct communication with the airflow.

* * * * *